United States Patent [19]

Mazzeo

[11] 4,027,940

[45] June 7, 1977

[54] ELECTRICAL CONNECTOR WITH CAPTIVE CLAMPING JAW

[75] Inventor: Charles F. Mazzeo, Scotch Plains, N.J.

[73] Assignee: Amerace Corporation, New York, N.Y.

[22] Filed: Aug. 10, 1976

[21] Appl. No.: 713,298

[52] U.S. Cl. ..... 339/272 R

[51] Int. Cl.[2] ..... H01R 7/14

[58] Field of Search ..... 339/263 R, 263 L, 272

[56] References Cited

UNITED STATES PATENTS

| | | | |
|---|---|---|---|
| 3,086,194 | 4/1963 | Price | 339/272 R |
| 3,346,835 | 10/1967 | Burniston | 339/272 R |

FOREIGN PATENTS OR APPLICATIONS

| | | | |
|---|---|---|---|
| 2,402,087 | 7/1975 | Germany | 339/272 R |
| 1,020,226 | 2/1966 | United Kingdom | 339/272 R |

*Primary Examiner*—Roy Lake
*Assistant Examiner*—Mark S. Bicks
*Attorney, Agent, or Firm*—S. Michael Bender; Richard A. Craig

[57] ABSTRACT

In an electrical connector of the type in which an electrical conductor is clamped between the end of a clamping screw and a clamping surface in an electrical contact member, a cup-like clamping jaw carried at the end of the clamping screw, the clamping jaw including a clamping base and a circumferentially continuous generally tubular wall having circumferentially spaced portions permanently deformed radially inwardly to capture the clamping jaw upon the clamping screw while enabling relative rotation between the clamping screw and the clamping jaw, and circumferentially spaced lobes projecting radially outwardly between the radially inwardly directed permanently deformed portions.

13 Claims, 7 Drawing Figures

ELECTRICAL CONNECTOR WITH CAPTIVE CLAMPING JAW

The present invention relates generally to electrical connectors and pertains, more specifically, to a clamping jaw captured at the end of a clamping screw threaded into an electrical contact member wherein an electrical conductor is to be clamped between the clamping jaw and an opposite clamping surface in the contact member.

A wide variety of electrical connectors is currently available in which a clamping screw clamps an electrical conductor within an electrical contact member. In many of these connectors, a clamping jaw is placed at the end of the clamping screw to engage the conductor with a swivel coupling between the clamping screw and the clamping jaw, thereby providing a nonrotating clamping member between the rotating clamping screw and the stationary conductor. In addition, it has been found advantageous to capture the clamping jaw upon the clamping screw for axial movement with the screw. Some clamping jaws include means for precluding removal of the clamping screw from the contact member, as well as means for precluding rotation of the clamping jaw with the clamping screw. An example of a prior art electrical connector as described in this paragraph is shown in Burniston U.S. Pat. No. 3,346,835, issued Oct. 10, 1967.

One difficulty encountered in the use of a swiveled clamping jaw captured at the end of a clamping screw is the tendency for the clamping jaw to become separated from the clamping screw, thereby rendering the clamping jaw ineffectual and impairing the effectiveness of the electrical connector.

It is therefore an object of the present invention to provide an electrical connector with a clamping jaw captured at the clamping end of a clamping screw therein with a swivel connection of such strength as to increase resistance to separation of the clamping jaw from the clamping screw.

Another object of the invention is to provide an electrical connector with a clamping jaw of the type described and which includes means for precluding rotation of the clamping jaw relative to the clamped conductor while permitting relative rotation between the clamping screw and the clamping jaw.

Still another object of the invention is to provide an electrical connector with a clamping jaw of the type described which can be attached to the clamping end of the clamping screw prior to insertion of the clamping screw into the contact member of the electrical connector and which, once installed, will prevent inadvertent removal of the clamping screw from the contact member.

A further object of the invention is to provide an electrical connector with a clamping jaw having a simplified construction which is readily fabricated in large numbers of uniform high quality.

The above objects, as well as still further objects and advantages, are attained by the present invention which may be described briefly as providing, in an electrical connector of the type including a contact member having opposite top and bottom walls and a clamping screw having axially opposite ends and a screw thread, the clamping screw being received within the top wall of the contact member for clamping a conductor between one of the opposite ends of the clamping screw and the clamping surface, the improvement comprising a cup-like clamping jaw placed over the one of the opposite ends of the clamping screw and including a clamping base juxtaposed with the one end and a circumferentially continuous, generally tubular wall extending axially from the clamping base toward the other of the opposite ends of the clamping screw, circumferentially spaced portions of the tubular wall being permanently deformed radially inwardly, coupling means integral with the clamping screw at the one end thereof cooperatively engaging the circumferentially spaced inwardly deformed portions of the tubular wall for retaining the cup-like clamping jaw in place upon the clamping screw while enabling rotation of the clamping screw relative to the clamping jaw, and circumferentially spaced lobes projecting radially outwardly between the inwardly deformed portions a radial distance sufficient to engage at least one of the side walls of the contact member to preclude rotation of the clamping jaw upon rotation of the clamping screw.

The invention will be more fully understood, while still further objects and advantages will become apparent, in the following detailed description of an embodiment of the invention illustrated in the accompanying drawing, in which.

Figure 1:
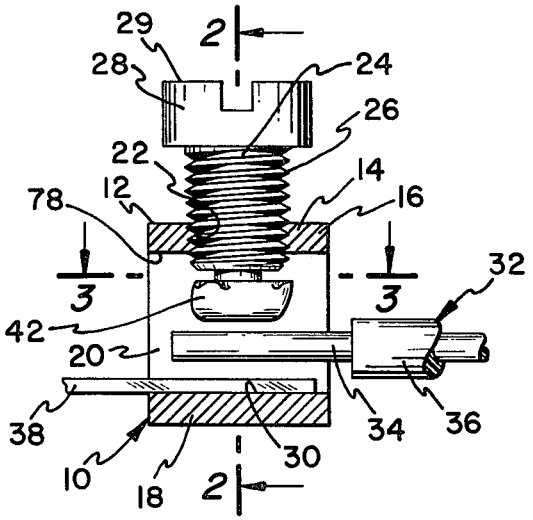
FIG. 1 is a longitudinal cross-sectional view of an electrical connector employing a captive clamping jaw constructed in accordance with the invention.
Figure 2:
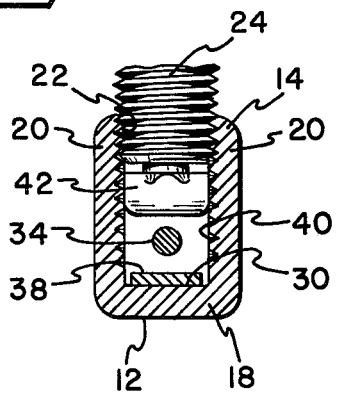
FIG. 2 is a cross-sectional view taken along line 2—2 of FIG. 1.
Figure 3:
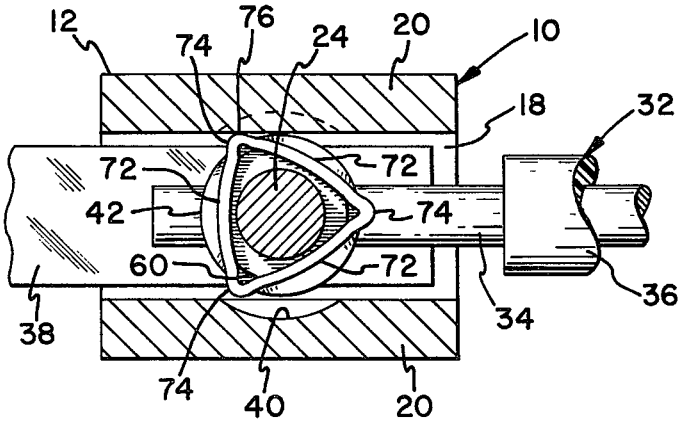
FIG. 3 is an enlarged cross-sectional view taken along line 3—3 of FIG. 1.

Referring now to the drawing, and especially to FIGS. 1, 2 and 3 thereof, an electrical connector 10 is seen to have an electrical contact member 12 with a tubular body 14 including a top wall 16, an opposite bottom wall 18 and opposite side walls 20. A threaded aperture 22 in the top wall 16 receives a clamping screw 24 having an external thread 26, and a slotted head 28 at one end 29 thereof. The bottom wall 18 has a clamping surface 30 located opposite the threaded aperture 22 and clamping screw 24.

In the illustrated example, an electrical wire 32, having a conductor 34 and insulator 36, is to be connected to a conductive strap 38, by means of the electrical connector 10. The conductor 34 and the strap 38 are juxtaposed with the clamping surface 30 of the contact member 12, and the clamping screw 24 will be moved axially downwardly, within the threaded aperture 22 and thread segments 40 in the side walls 20. A clamping jaw 42, constructed in accordance with the invention, is carried at the other end 44 of the clamping screw 24 and will engage the conductor 34 to urge the conductor 34 against the strap 38 such that the conductor 34 and strap 38 will become clamped between the clamping screw 24 and the clamping surface 30 on bottom wall 18 of the contact member 12. Clamping jaw 42 is captured upon end 44 of clamping screw 24 (see FIG. 6) with a swivel connection so that clamping jaw 42 will not turn relative to conductor 34, but will permit rotation of clamping screw 24 relative to clamping jaw 42.

Figure 4:
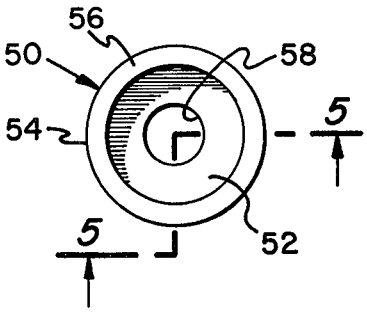
FIG. 4 is a plan view of a cup-like blank employed in the construction of the clamping jaw.
Figure 5:
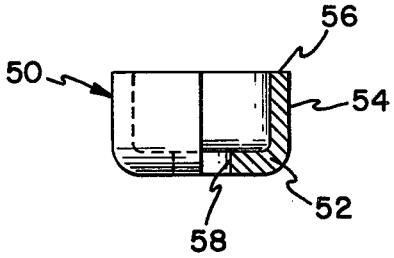
FIG. 5 is a cross-sectional view taken along line 5—5 of FIG. 4.

Turning now to FIGS. 4 and 5, clamping jaw 42 is constructed from a cup-shaped blank 50 having an essentially flat base 52 and a circumferentially continuous, generally tubular wall 54 extending axially upwardly from the base 52 to a terminal edge 56. Wall 54 is described as "continuous" in that the wall is unbroken around the periphery thereof. An opening 58 is provided in base 52 for purposes which will be described below.

Figure 6:
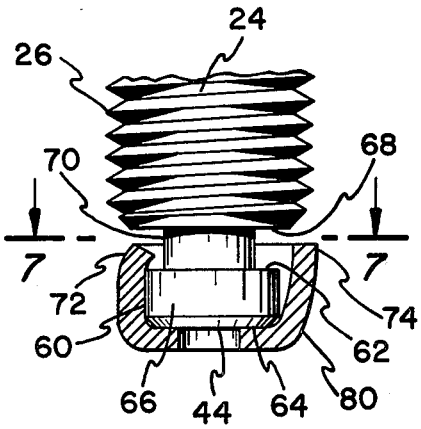
FIG. 6 is an elevational view illustrating a clamping jaw of the invention, in section, installed at the end of a clamping screw.
Figure 7:
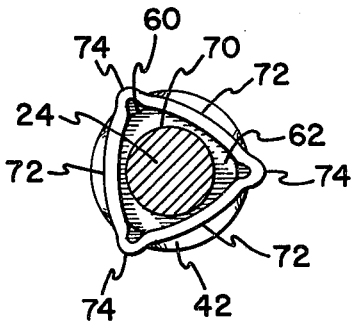
FIG. 7 is a cross-sectional view taken along line 7—7 of FIG. 6.

As best seen in FIGS. 6 and 7, clamping jaw 42 is captured at the end 44 of clamping screw 24 by coupling means including an annular lip 60 integral with the clamping screw 24 and having an outside diameter smaller than the root diameter of screw thread 26. Lip 60 includes an upper surface 62, a lower surface 64 spaced axially from the upper surface 62, and an outer peripheral surface 66 between the upper and lower surfaces 62 and 64. The upper surface 62 of lip 60 is spaced from the lower end 68 of the thread 26 of clamping screw 24, thereby establishing an annular groove 70. The inside diameter of groove 70 is smaller than the outside diameter of lip 60. In order to affix clamping jaw 42 upon clamping screw 24, blank 50 is placed over lip 60, with base 52 juxtaposed with lower surface 64, and the wall 54 is permanently deformed radially inwardly at locations spaced circumferentially around the wall. In the illustrated example, three circumferentially spaced portions 72 of wall 54 are permanently deformed radially inwardly over lip 60 and beyond the outer peripheral surface 66 thereof to retain the clamping jaw 42 in place upon the clamping screw 24. Preferably, the inwardly deformed portions 72 are located equidistant from one another and coincide with the terminal edge 56 of wall 54 to enter groove 70. Sufficient clearance is provided between the clamping jaw 42 and the lip 60 to enable the clamping jaw 42 to rotate, or swivel, on the clamping screw 24.

Upon forming the inwardly deformed portions 72, the remaining portions of wall 54 are pushed radially outwardly to form radially projecting lobes 74 located between portions 72. As best seen in FIGS. 3 and 6, lobes 74 extend radially outwardly beyond the root diameter of screw thread 26. When clamping screw 24 is rotated about its longitudinal axis, one of the lobes 74 will engage a side wall 20 of the contact member 12, as seen at 76 in FIG. 3, to prevent rotation of the clamping jaw 42 while enabling rotation of the clamping screw 24 relative to the clamping jaw 42. Preferably, lobes 74 extend radially outwardly beyond the root diameter of thread 26 so that upon backing of the clamping screw 24 away from the clamped position, inadvertent removal of the clamping screw 24 from aperture 22 is precluded by the abutment of the lobes 74 against the underside 78 of top wall 16. The tapered configuration of lobes 74, as seen at 80 in FIG. 6, facilitates the initial insertion of clamping screw 24, with clamping jaw 42 attached thereto, into aperture 22, the lobes 74 merely flexing inwardly to enable such insertion.

Because wall 54 is unbroken, flexibility of the wall is very limited and the clamping jaw 42 is held securely in place upon the clamping screw 24. The reinforcement provided by the ribbed configuration established by the presence of lobes 74 unitary with the inwardly deformed portions 72 enhances the strength of the securement. By assuring that the inwardly deformed portions 72 comprise at least about seventy-five percent of the total periphery of terminal edge 56, an optimum balance is attained between inwardly deformed portions and lobes to assure good performance from the standpoint of high resistance to separation of the clamping jaw 42 from the clamping screw 24 and appropriate non-rotation of the clamping jaw 42 relative to the stationary conductor 34. It has been found that the employment of three lobes 74 spaced circumferentially equidistant from one another attains the desired optimum balance. Opening 58 in the base 52 of the clamping jaw 42 enhances the gripping action of the clamping jaw 42 upon the conductor 34 by allowing a portion of the conductor to be forced into the opening 58 during clamping.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In an electrical connector of the type including a contact member having opposite top and bottom walls and opposite side walls, a clamping surface on the bottom wall and a clamping screw having axially opposite ends and a screw thread, the clamping screw being received within the top wall of the contact member for clamping a conductor between one of the opposite ends of the clamping screw and the clamping surface, the improvement comprising:

a cup-like clamping jaw placed over said one of the opposite ends of the clamping screw and including a clamping base juxtaposed with the one end and a circumferentially continuous, generally tubular wall extending axially from the clamping base toward the other of the opposite ends of the clamping screw;

circumferentially spaced portions of the tubular wall being permanently deformed radially inwardly;

coupling means integral with the clamping screw at the one end thereof cooperatively engaging the circumferentially spaced inwardly deformed portions of the tubular wall for retaining the cup-like clamping jaw in place upon the clamping screw while enabling rotation of the clamping screw relative to the clamping jaw; and circumferentially spaced lobes projecting radially outwardly between the inwardly deformed portions a radial distance sufficient to engage at least one of the side walls of the contact member to preclude rotation of the clamping jaw upon rotation of the clamping screw.

2. The invention of claim 1 wherein:

the coupling means includes a lip having a first surface extending generally radially adjacent one end of the clamping screw, a second radially extending surface spaced axially from the first surface in the direction toward the opposite end of the clamping screw, and an outer periphery between the first and second surfaces; and the inwardly deformed portions of the tubular wall extend over the second surface of the lip.

3. The invention of claim 2 wherein the lip has an outside diameter smaller than the root diameter of the screw thread of the clamping screw.

4. The invention of claim 2 wherein the number of inwardly deformed portions is three and the number of lobes is three.

5. The invention of claim 2 wherein the lobes are spaced circumferentially equidistant from one another.

6. The invention of claim 2 wherein the wall of the clamping jaw has a terminal edge adjacent the second surface of the lip and the permanently deformed portions coincide with the terminal edge such that portions of the terminal edge are located radially inwardly of the outer periphery of the lip.

7. The invention of claim 6 wherein the inwardly deformed portions extend along at least about seventy-five percent of the periphery of the terminal edge of the wall of the clamping jaw.

8. The invention of claim 1 wherein:

the coupling means includes a groove in the clamping screw; and the inwardly deformed portions are received within the groove.

9. The invention of claim 8 wherein the groove is annular and has an inside diameter smaller than the root diameter of the screw thread of the clamping screw.

10. The invention of claim 8 wherein the number of inwardly deformed portions is three and the number of lobes is three.

11. The invention of claim 8 wherein the lobes are spaced circumferentially equidistant from one another.

12. The invention of claim 8 wherein the wall of the clamping jaw has a terminal edge adjacent the groove and the permanently deformed portions coincide with the terminal edge such that portions of the terminal edge are located radially inwardly within the groove.

13. The invention of claim 12 wherein the inwardly deformed portions extend along at least about seventy-five percent of the periphery of the terminal edge of the wall of the clamping jaw.

* * * * *